US005975968A

United States Patent [19]

Nakamura

[11] Patent Number: 5,975,968

[45] Date of Patent: Nov. 2, 1999

[54] TRIM-TILT DEVICE FOR MARINE PROPULSION UNIT

[75] Inventor: Tamotsu Nakamura, Saitama, Japan

[73] Assignee: Showa Corporation, Saitama, Japan

[21] Appl. No.: 09/133,869

[22] Filed: Aug. 13, 1998

[30] Foreign Application Priority Data

Nov. 12, 1997 [JP] Japan ..... 9-325195

[51] Int. Cl.[6] ..... B63H 5/125

[52] U.S. Cl. ..... 440/61; 92/52; 440/56

[58] Field of Search ..... 114/280, 282; 440/53, 56, 61, 65, 52; 92/163, 164, 52, 53

[56] References Cited

U.S. PATENT DOCUMENTS 3,188,917 6/1965 Quayle ..... 92/52

3,250,240 5/1966 Ziegler ..... 115/17

5,529,519 6/1996 Nakamura et al. ..... 440/61

FOREIGN PATENT DOCUMENTS 7-69289 5/1995 Japan ..... 20/8

*Primary Examiner*—Sherman Basinger
*Assistant Examiner*—Patrick Muldoon
*Attorney, Agent, or Firm*—Dvorak & Orum

[57] ABSTRACT

A trim-tilt device 20 for a marine boat motor has a housing 31 forming a large-diameter trim chamber 32, a cylinder 41 inserted into the trim chamber 32 of the housing 31 to form a small-diameter tilt chamber 42, and a piston rod telescopically inserted into the tilt chamber 42 of the cylinder 41. Built into the wall of the cylinder 41 is the passage 46 for interconnecting a first trim chamber 32A and a first tilt chamber 42A.

5 Claims, 6 Drawing Sheets

TRIM-TILT DEVICE FOR MARINE PROPULSION UNIT

BACKGROUND OF THE INVENTION

1. Field of the Invention

The present invention relates to a trim-tilt device for a marine propulsion unit such as an outboard motor or outboard or inboard engine.

2. Description of the Related Art

Conventionally, the trim-tilt device for a marine propulsion unit has a cylinder device interposed between a hull and the propulsion unit which is tiltably supported by the hull. By executing supply and discharge control of a hydraulic fluid from a hydraulic fluid supply/discharge device to a cylinder device or vice versa, the cylinder device is expanded and contracted to thereby trim and tilt the marine propulsion unit. The trimming operation serves to cause the marine propulsion unit during sailing to be tilted against the propulsion force within a prescribed trim region and thereby trimmed upward and downward so as to adjust the sailing posture of the marine propulsion unit with respect to a change in the load in the water surface and thereby obtain the most favorable state of sailing. A relatively large magnitude of driving force is needed for the cylinder device. Also, the tilting operation causes the marine propulsion unit that is in the process of anchoring, to be tilted against gravitational force within a prescribed tilt region and thereby tilted upward and downward so as to raise the marine propulsion unit from the water surface. A relatively small magnitude of driving force is sufficient for the cylinder device.

Further, in a trim-tilt device whose cylinder device having a single-cylinder in order to enhance the outer appearance and to make the trim-tilt device compact in size, there is a type which is described in U.S. Pat. No. 325,240.

The conventional cylinder device comprises a housing connected to one of the hull and the marine propulsion unit and forms a large-diameter trim chamber; a cylinder that is telescopically inserted into the trim chamber of the housing and forms a small-diameter tilt chamber, a large-diameter trim piston that is fixed to an end portion of the cylinder within the trim chamber of the housing and that partitions the trim chamber into a first trim chamber of a cylinder accommodation side and a second trim chamber of an anti cylinder accommodation side; a piston rod that is connected to the other of the hull and the marine propulsion unit and that is telescopically inserted into the tilt chamber of the cylinder; and a small-diameter tilt piston that is fixed to an end of the piston rod within the tilt chamber of the cylinder and that partitions the tilt chamber into a first tilt chamber of a piston rod accommodation side and a second tilt chamber of an anti piston rod accommodation side. A standing pipe fixed to the trim piston is slidably passed through the tilt piston. By the intrapipe passage of the standing pipe, the first trim chamber and the first tilt chamber are communicated with each other, whereby the first trim chamber and the first tilt chamber are communicated with a supply side of the hydraulic fluid supply/discharge device during a contraction stroke of the trimming operation and tilting operation, and are communicated with a discharge side thereof during an expansion stroke of each thereof. The second trim chamber and the second tilt chamber are communicated with each other by way of the communication passage formed in the trim piston by being passed there through, whereby it has been arranged that the second trim chamber and the second tilt chamber are communicated with the supply side of the hydraulic fluid supply/discharge device during the expansion stroke of each trimming operation and tilting operation and are communicated with the discharge side thereof during the contraction stroke of each thereof.

In this prior art, since the first trim chamber and the first tilt chamber communicate with each other by the standing pipe fixed to the trim piston, there is suppression of exposure to the outside of the cylinder device of the hydraulic fluid that is supplied and discharged between the hydraulic fluid supply/discharge device and the cylinder device.

However, the conventional technique has the following problems.

(1) In order to reduce the number of pipes exposed around the cylinder device, the standing pipe fixed to the trim piston is slidably passed through the tilt piston, with the result that the construction of the cylinder device is complex.

(2) The portions of the cylinder device that are needed to be fluid-tightly sealed become five in total number as a result of adding a portion where the standing pipe slides with respect to the through-hole of the tilt piston to four portions: where the cylinder slides with respect to the cylinder guide provided in the housing; where the trim piston slides with respect to the inner surface of the trim chamber of the housing, where the piston rod slides with respect to the rod guide provided in the cylinder and where the tilt piston slides with respect to the inner surface of the tilt chamber of the cylinder. Because of this, sealing becomes a serious problem.

(3) During the tilting operation, the tilt piston is moved up and down in such a way that its outer-peripheral portion is in sliding contacted with the inner surface of the tilt chamber of the cylinder and its inner-peripheral portion is in sliding contacted with the standing pipe. Therefore, if the concentricity between the cylinder and the standing pipe is bad, the assemblability and slidability thereof are also bad, resulting in the impairment of the tilt-operating efficiency.

SUMMARY OF THE INVENTION

The object of the present invention is to provide a trim-tilt device for a marine propulsion unit which while simplifying the construction of the cylinder device suppresses exposure of pipes around the cylinder device, enhances the sealability of the cylinder device and increases the tilt-operating efficiency.

The present invention provides a trim-tilt device for a marine propulsion unit wherein a cylinder device is mounted between a hull and the marine propulsion unit and is freely tiltably supported by the hull; and a hydraulic fluid is supplied from a hydraulic fluid supply/discharge device into the cylinder device and discharged from the cylinder device into the hydraulic fluid supply/discharge device to thereby expand and contract the cylinder device and thereby trim and tilt the marine propulsion unit. The cylinder device has a housing that is connected to one of the hull and marine propulsion unit and that forms a large-diameter trim chamber. A cylinder is telescopically inserted into the trim chamber of the housing and forms a small-diameter tilt chamber. A large-diameter trim piston is fixed to an end portion of the cylinder within the trim chamber of the housing and partitions the trim chamber into a first trim chamber of a cylinder accommodation side and a second trim chamber of an anti cylinder accommodation side. A piston rod is connected to the other of the hull and the marine propulsion unit and is telescopically inserted into the tilt chamber of the cylinder. A small-diameter tilt piston is fixed to an end portion of the piston rod within the tilt chamber of the cylinder to partition the tilt chamber into a first tilt chamber of a piston rod accommodation side and a second tilt chamber of an anti piston rod accommodation side, whereby a wall of the cylinder has built therein a communication passage for communicating the first trim chamber and the first tilt chamber with each other, whereby the first trim chamber and the first tilt chamber are communicated with a supply side of the hydraulic fluid supply/discharge device during a contraction stroke of each trim operation and tilt operation and are in communication with a discharge side of the hydraulic fluid supply/discharge device during an expansion stroke, and whereby the trim piston has a communication passage for communicating the second trim chamber and the second tilt chamber with each other, whereby the second trim chamber and the second tilt chamber are in communication with the supply side of the hydraulic fluid supply/discharge device during the expansion stroke of each of the trim operation and tilt operation and are in communication with the discharge side of the hydraulic fluid supply/discharge device during the contraction stroke thereof.

BRIEF DESCRIPTION OF THE DRAWINGS

The present invention will be understood more fully from the detailed description given hereinbelow and from the accompanying drawings of the preferred embodiments of the invention.

In the drawings.

DESCRIPTION OF THE PREFERRED EMBODIMENTS

Figure 1:
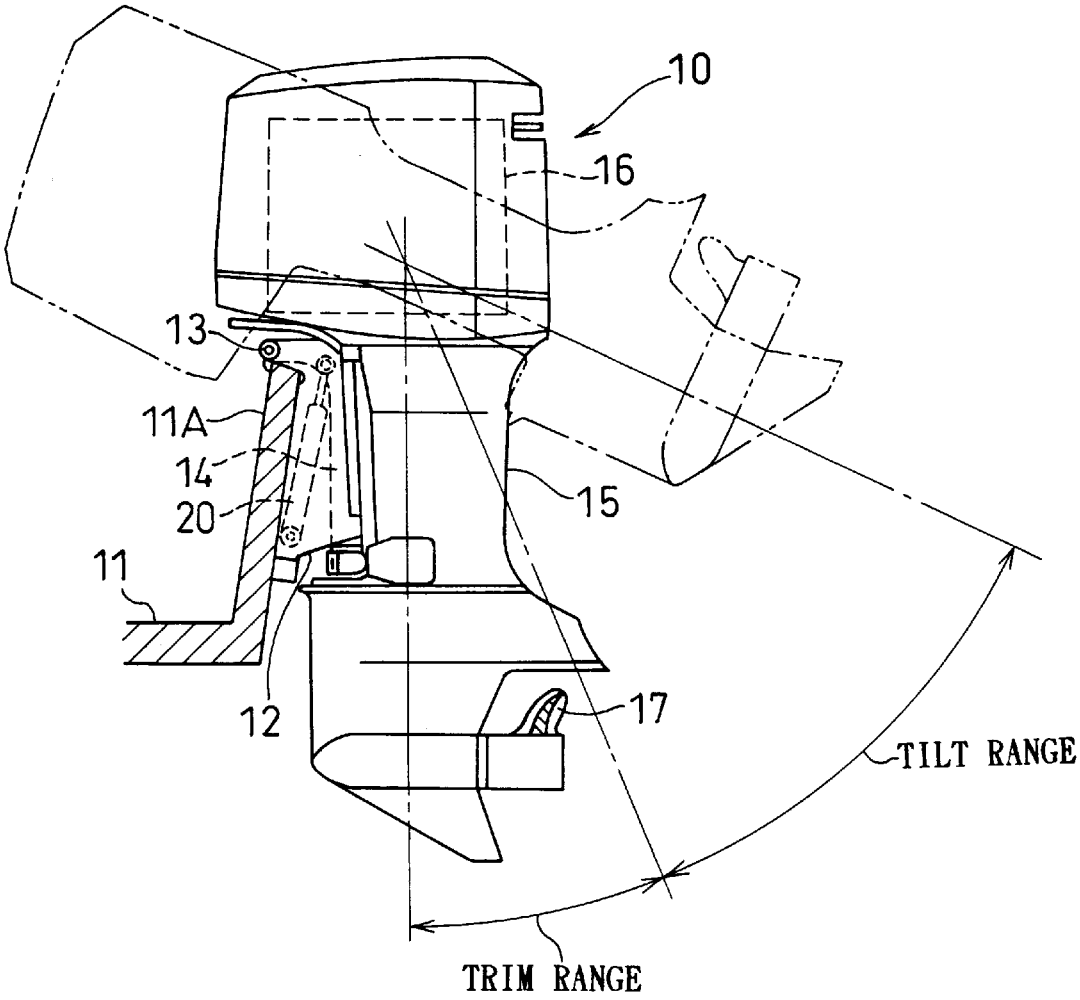
FIG. 1 is a view illustrating a marine propulsion unit.

A marine propulsion unit 10 in the form of an outboard motor, or an outboard or inboard motor has a clamp bracket 12 fixed to a stern board 11A of a boat hull 11. To the clamp bracket 12 a swivel bracket 14 is pivoted through a tilt shaft 13 and is tiltable about the substantially horizontal shaft. To the swivel bracket 14 a propulsion unit 15 is pivoted through a steerage-changing shaft that is substantially vertically disposed and not illustrated in such a way that the propulsion unit 15 is rockable about the steerage-changing shaft. An engine unit 16 is loaded at the top of the propulsion unit 15 and a propeller 17 is fitted to a lower part of the propulsion unit 15.

In the marine propulsion unit 10, the propulsion unit 15 is tiltably supported by the clamp bracket 12 fixed to the hull 11 through the tilt shaft 13 and swivel bracket 14. A cylinder 21 of a trim-tilt device 20 is interposed between the clamp bracket 12 and the swivel bracket 14. The cylinder device 21 is expanded and contracted by supply or disharge of a hydraulic fluid between a hydraulic fluid supply/discharge device 22 and the cylinder device 21. The propulsion unit 15 is thereby made tiltable in a trim or tilt region of FIG. 1. It is to be noted that the marine propulsion unit 10 may take an optimum sailing posture with respect to a in the load of the water surface by retaining the propulsion unit 15 in a state of relatively gentle slope within the trim region.

(Cylinder Device 21)

Figure 2:
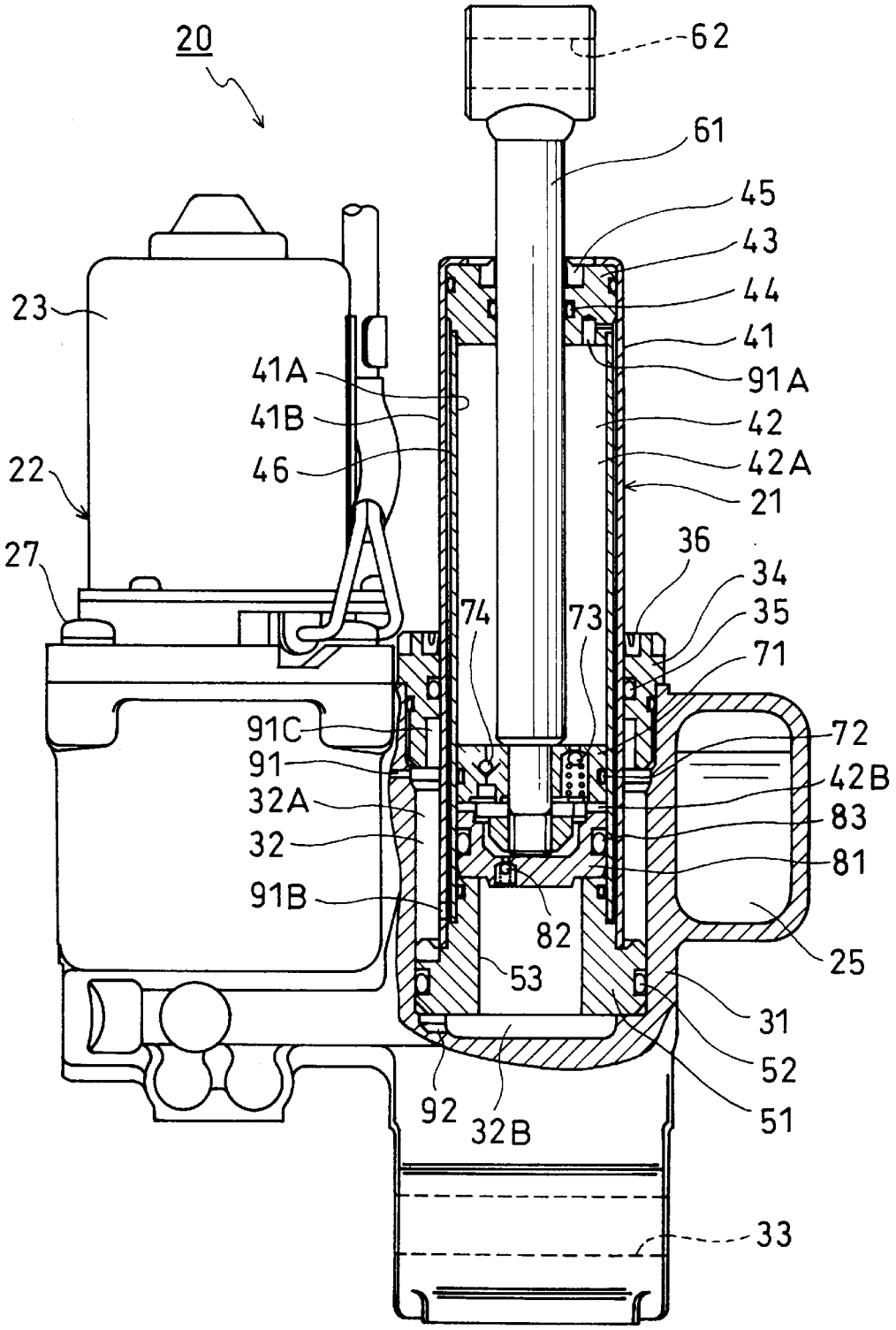
FIG. 2 is a view illustrating a trim-tilt device.
Figure 3:
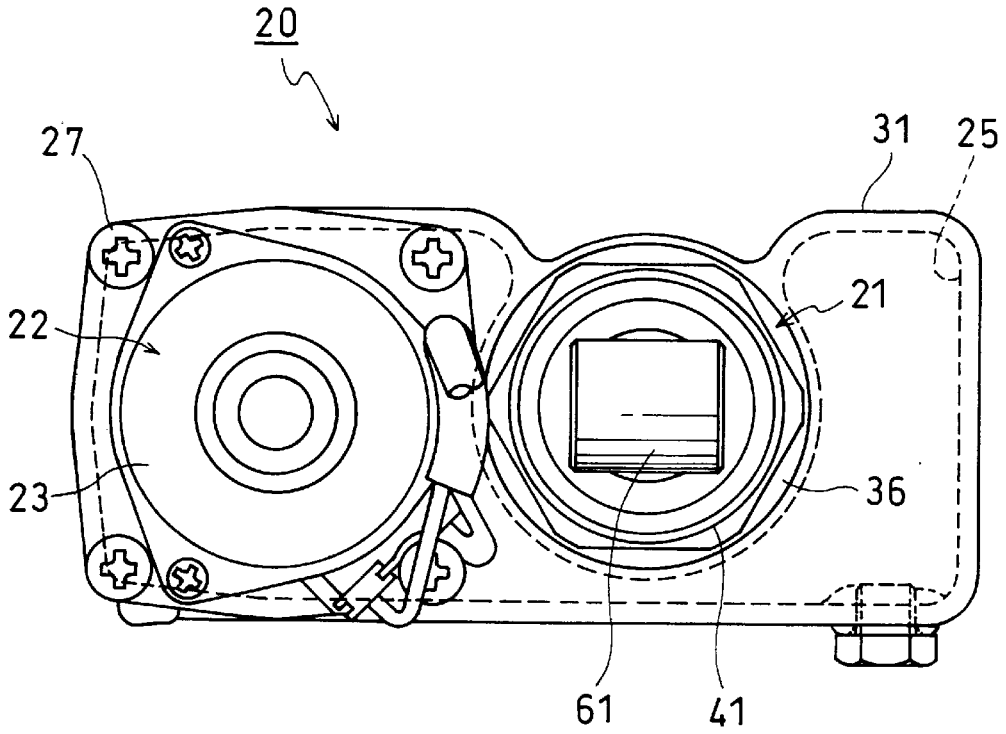
FIG. 3 is a plan view of FIG. 2.

As illustrated in FIGS. 1 and 2, the cylinder device 21 of the trim-tilt device 20 has a housing 31 that is used by being connected to the clamp bracket 12, the housing 31 having a large-diameter trim chamber 32 formed therein. It is to be noted that the housing 31 is cast-molded using, for example, an aluminum alloy and is equipped with a mounting-pin insertion hole 33 for mounting the housing onto the clamp bracket 12.

Also, the cylinder device 21 has a cylinder 41 which when the trim-up/down operation in the trim region is performed becomes telescopically inserted into a trim chamber 32 from a cylinder guide 34 provided in an open end of the housing 31, the cylinder 41 having a small-diameter tilt chamber 42 formed therein. The cylinder guide 34 is equipped with a seal member 35 such as an O-ring and a water seal 36 which slide on an outer surface of the cylinder 41.

Also, the cylinder device 21 has a large-diameter trim piston 51 fixed to an end portion of the cylinder 41 that is situated in the trim chamber 32 of the housing 31. The trim piston 51 is equipped with a seal member 52 such as an O-ring which slides on an inner surface of the trim chamber 32 and partitions the trim chamber 32 into a first trim chamber 32A on a cylinder 41 accommodation side and a second trim chamber 32B on an anti cylinder 41 accommodation side.

Also, the cylinder device 21 has a piston rod 61 that is provided by being connected to the swivel bracket 14, the piston rod 61 is inserted into the tilt chamber 42 from a rod guide 43 that is provided in an open end of the cylinder 41 in such a way as to be expanded and contracted when the tilt-up/down operation in the tilt region is performed. The rod guide 43 is equipped with a seal member 44 such as an O-ring and a water seal 45 which is in sliding contact with an outer surface of the piston rod 61. The piston rod 61 is equipped with a mounting-pin insertion hole 62 for mounting the cylinder device 21 onto the swivel bracket 14.

Also, the cylinder device 21 has a small-diameter tilt piston 71 that is fixed to an end portion of the piston rod 61 situated within the tilt chamber 42 of the cylinder 41. The tilt piston 71 is equipped with a seal member 72 such as an O-ring which is in sliding contact with the inner surface of the cylinder 41, and partitions the tilt chamber 42 into a first tilt chamber 42A on a piston-rod 61 accommodation side and a second tilt chamber 42B on an anti piston-rod 61 accommodation side.

The tilt piston 71 has an expansion side buffer valve 73 and a check valve 74. The expansion side buffer valve 73 is opened by a set pressure for the purpose of guarding a hydraulic circuit when an impact is received in the expansion direction at cylinder device 21, as for example, when a floating log collides with the propulsion unit 15, and transfers the hydraulic fluid of the first tilt chamber 42A to a side of a free piston 81 as later described situated within the second tilt chamber 42B, thereby enabling the expansion of the piston rod 61. At this time, the free piston 81 remains at its own position and only the tilt piston 71 alone works. The check valve 74 is opened when after the above-described opening of the expansion side buffer valve 73 the tilt piston 71 of the piston rod 61 tends to return by the weight of the propulsion unit 15 to the original position to thereby return the hydraulic fluid between the tilt piston 71 and the free piston 81 to the first tilt chamber 42A.

Also, the cylinder device 21 has the free piston 81 which is usually set to the position of its contact with the tilt piston 71 within the second tilt chamber 42B of the cylinder 41. The free piston 81 is equipped with a seal member 83 such as an O-ring which contacts the inner periphery of the cylinder 41. Also, the free piston 81 has a resetting check valve 82. When an external force that acts in the expansion direction of the cylinder device 21 is experienced for some reason or other at the time of a bump during backward movement of the marine propulsion unit 10, a braking operation during forward movement thereof or a starting operation for starting movement thereof, there is the likelihood that the expansion side buffer valve 73 will be opened and the piston rod 61 will therefore be expanded with the result that the fluid that has been transferred from the first tilt chamber 42A to the second tilt chamber 42B will enter in between the tilt piston 71 and the free piston 81. When wanting to make a forced return to the original position by the pumping operation, the resetting check valve 82 is opened whereby the piston rod 61 is reset to its original position where the tilt piston 71 and the free piston 81 come in contact with each other.

Meanwhile, in the cylinder device 21, the cylinder 41 is made of a doubled-pipe structure and the gap between an inner cylinder 41A and an outer cylinder 41B is used as a communication passage 46 for communicating the first trim chamber 32A and the first tilt chamber 42A with each other. The first trim chamber 32A is connected directly to a first flow passage 91 formed in the housing 31 while, on the other hand, the first tilt chamber 42A is connected to the first flow passage 91 through a passage 91A formed in the rod guide 43 of the cylinder 41, the communication passage 46 of the cylinder 41, a passage 91B formed in the outer pipe 41B of the cylinder 41, a passage 91C formed in the cylinder guide 34 of the housing 31, and the first trim chamber 32A. As a result of this, the first trim chamber 32A and the first tilt chamber 42A are connected, (a) through the first flow passage 91, with the supply side of the hydraulic fluid supply/discharge device 22 during the contraction stroke of each of the trim and tilt operations and, (b) through the first flow passage 91, with the discharge side of the hydraulic fluid supply/discharge device 22 during the expansion stroke of each thereof.

Also, in the cylinder device 21, the trim piston 51 has a through-hole like communication passage 53 for connecting together second trim chamber 32B and the second tilt chamber 42B. The second trim chamber 32B is connected directly to a second flow passage 92 formed in the housing 31 and the second tilt chamber 42B is connected to the second flow passage 92 through the communication passage 53 of the trim piston 51 and the second trim chamber 32B. As a result of this, the second trim chamber 32B and the second tilt chamber 42B are communicated, (a) through the second flow passage 92, with the supply side of the hydraulic supply/discharge device 22 during the expansion stroke of each of the trim and tilt operations and, (b) through the second flow passage 92, with the discharge side of the hydraulic fluid supply/discharge device 22 during the contraction stroke of each thereof.

(Hydraulic Fluid Supply/Discharge Device 22)

The hydraulic fluid supply/discharge device 22 is comprised of a reversible motor 23, a reversible gear pump 24, a tank 25, and a switching-valve equipped flow passage 26, by which the hydraulic fluid can be supplied and discharged, through the first flow passage 91 and the second flow passage 92, between the hydraulic fluid supply/discharge device 22 and the first trim chamber 32A, second trim chamber 32B, first tilt chamber 42A and second tilt chamber 42B of cylinder device 21.

Figure 4:
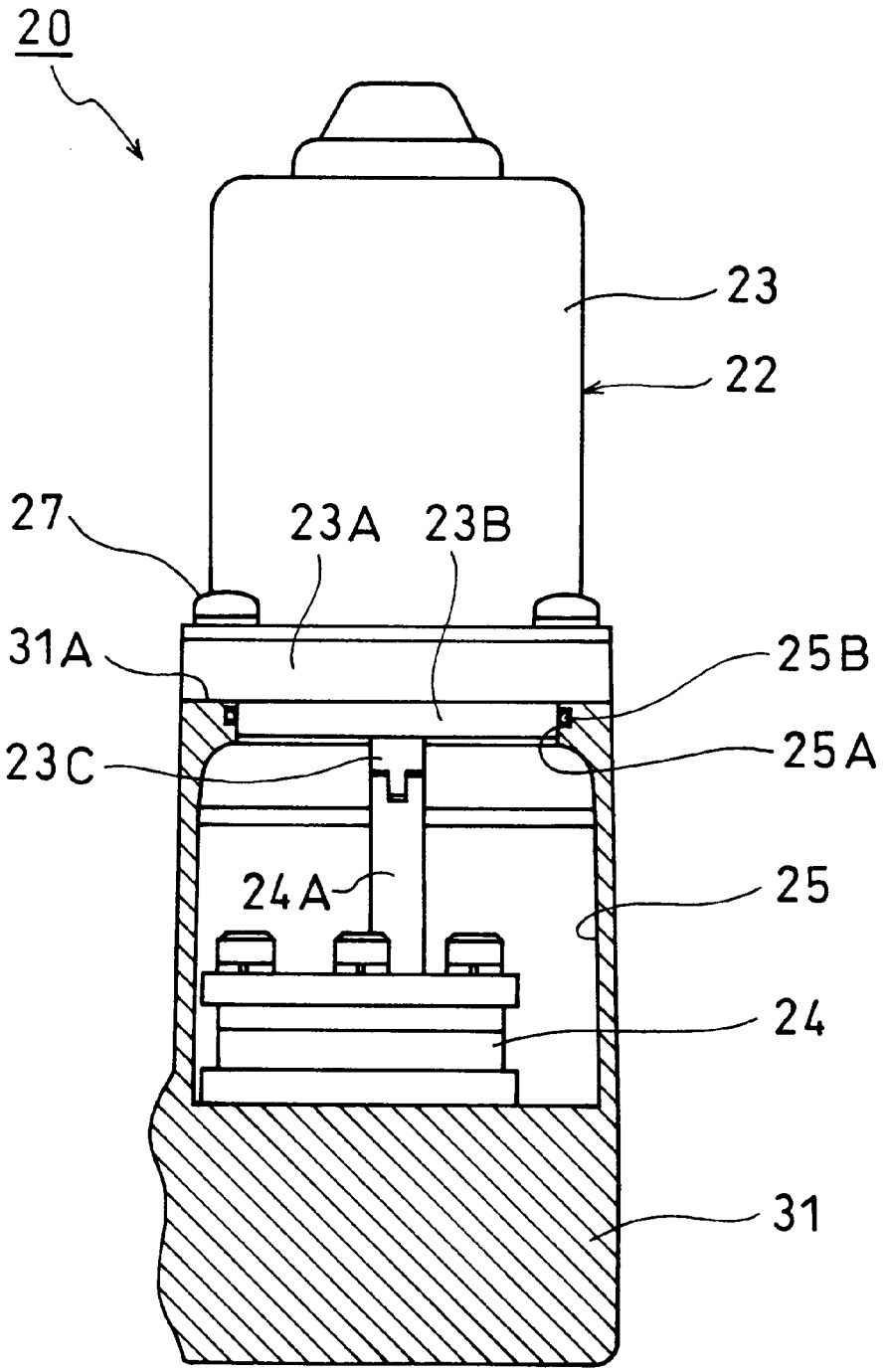
FIG. 4 is a view illustrating a state where a hydraulic fluid supply/discharge device is assembled into a housing of a cylinder device.

At this time, as illustrated in FIG. 4, the hydraulic fluid supply/discharge device 22 is arranged with a mounting base 23A for mounting a motor 23 installed on a motor installation surface 31A formed in the housing 31 of the cylinder 21. The mounting base 23A is fixed thereto by bolts 27, whereby the motor 23 is laterally juxtaposed with the cylinder 41 of the cylinder 21.

The hydraulic fluid supply/discharge device 22 has a void space portion that extends to both sides of the trim chamber 32 in the housing 31 of the cylinder 21 in such a way as to surround the same and uses this void space portion as the tank 25 in which the hydraulic fluid is stored. An opening 25A is formed in the portion within the tank 25 of the housing 31 which corresponds to a lower portion of the motor 23, whereby a fitting portion 23B that connects to the mounting base 23A of the motor 23 is fluid-tightly fitted into the opening 25A through a seal member 25B such as an O-ring. Under the motor 23 within the tank 25 formed in the housing 31, the pump 24 is fixedly disposed in a state of being kept immersed in the fluid, whereby an output shaft 23C protruding from the fitting portion 23B of the motor 23 is connected to a driven shaft 24A of the pump 24.

The switching-valve equipped flow passage 26 of the hydraulic fluid supply/discharge device 22 which connects the pump 24 to the first flow passage 91 and second flow passage 92 is built in the housing 31, the switching-valve equipped flow passage 26 being provided with a shuttle type switching valve 101, check valves 102 and 103, contraction side relief valve 104, expansion side relief valve 105, contraction side buffer valve 106 and manual switching valve 107.

The shuttle type switching valve 101 has a shuttle piston 111 and a first check valve 112A and second check valve 112B that are located on both sides of the shuttle piston 111, and defines a first shuttle chamber 113A on the first check valve 112A side of the shuttle piston 111 and defines a second shuttle chamber 113B on the second check valve 112B side of the shuttle piston 111. The first check valve 112A is opened by the pressure of the transmission fluid applied to the first shuttle chamber 113A through a pipe passage 93A by the pump 24 rotating in the forward direction. The second check valve 112B can be opened by the pressure of the transmission fluid applied to the second shuttle chamber 113B through a pipe passage 93B by the pump 24 rotating in the reverse direction. Also, the shuttle piston 111 opens the second check valve 112B by the pressure of the transmission fluid resulting from the forward rotation of the pump 24 and can open the first check valve 112A by the pressure of the transmission fluid resulting from the reverse rotation of the pump 24.

The first check valve 112A of the shuttle type switching valve 101 is connected to the first flow passage 91 and the second check valve 112B is connected to the second flow passage 92.

A check valve 102 is mounted on an intermediate portion of a connection pipe passage 94A between the pump 24 and the tank 25. In the tilt-up stage of the marine propulsion unit 10, the internal volume of the first tilt chamber 42A increases in volume and the piston rod 61 is retracted, with the result that the circulating amount of fluid of the hydraulic fluid becomes deficient by that extent. Therefore, the check valve 102 is opened to thereby supplement from the pump 25 to the pump 24 the portion which corresponds to the deficiency of the circulating amount of fluid.

A check valve 103 is mounted on an intermediate portion of a connection pipe passage 94B between the pump 24 and the tank 25. Where the pump 24 is still in stage at the point in time when at the trim-down stage of the marine propulsion unit 10 the trim piston 51 reaches its position of maximum contraction at which the trim-down stage is completed and as a result the return fluid from the second trim chamber 32B to the pump 24 stops, and the check valve 103 is opened whereby the hydraulic fluid can be supplied from the tank 25 to the pump 24.

The contraction side relief valve 104 is connected to the first shuttle chamber 113A. The contraction side relief valve 104 is intended to permit the hydraulic circuit pressure to be relieved into the tank 25 under a set pressure in order to return to the tank 25 the amount of fluid corresponding to the volume of the rod, which is to remain at the time of the tilt-down and trim-down operations and in order to guard the hydraulic circuit while continuing to operate the pump 24 even after the trim-down operation has been completed.

The expansion side relief valve 105 is connected to the second shuttle chamber 113B. This valve 105 is intended to permit the hydraulic circuit pressure to be relieved into the tank 25 under a set pressure in order to guard the hydraulic circuit while continuing to operate the pump 24 even after the tilt-up operation time is completed and the piston rod 61 has reached its position of maximum expansion.

The contraction side buffer valve 106 is intended to relieve the hydraulic circuit pressure under a set pressure into the tank 25 when an impact has been applied to the propulsion unit 15 in the contraction direction of the piston rod 61 (for example, when an obstacle has bumped against the propulsion unit 15 from behind) during a sailing with the tilt piston 71 and free piston 81 of the cylinder device 21 being located at an intermediate position of the tilt chamber 42.

The manual switching valve 107 is interposed on a connecting passage 95 between the first flow passage 91 and the second flow passage 92 and, by connecting the first flow passage 91 and the second flow passage 92 with each other. This permits manual expansion and contraction of the cylinder device 21 to thereby make the propulsion unit 15 tiltable in each of the trim and tilt regions.

The operation of the trim-tilt device 20 will hereafter be explained.

Figure 5:
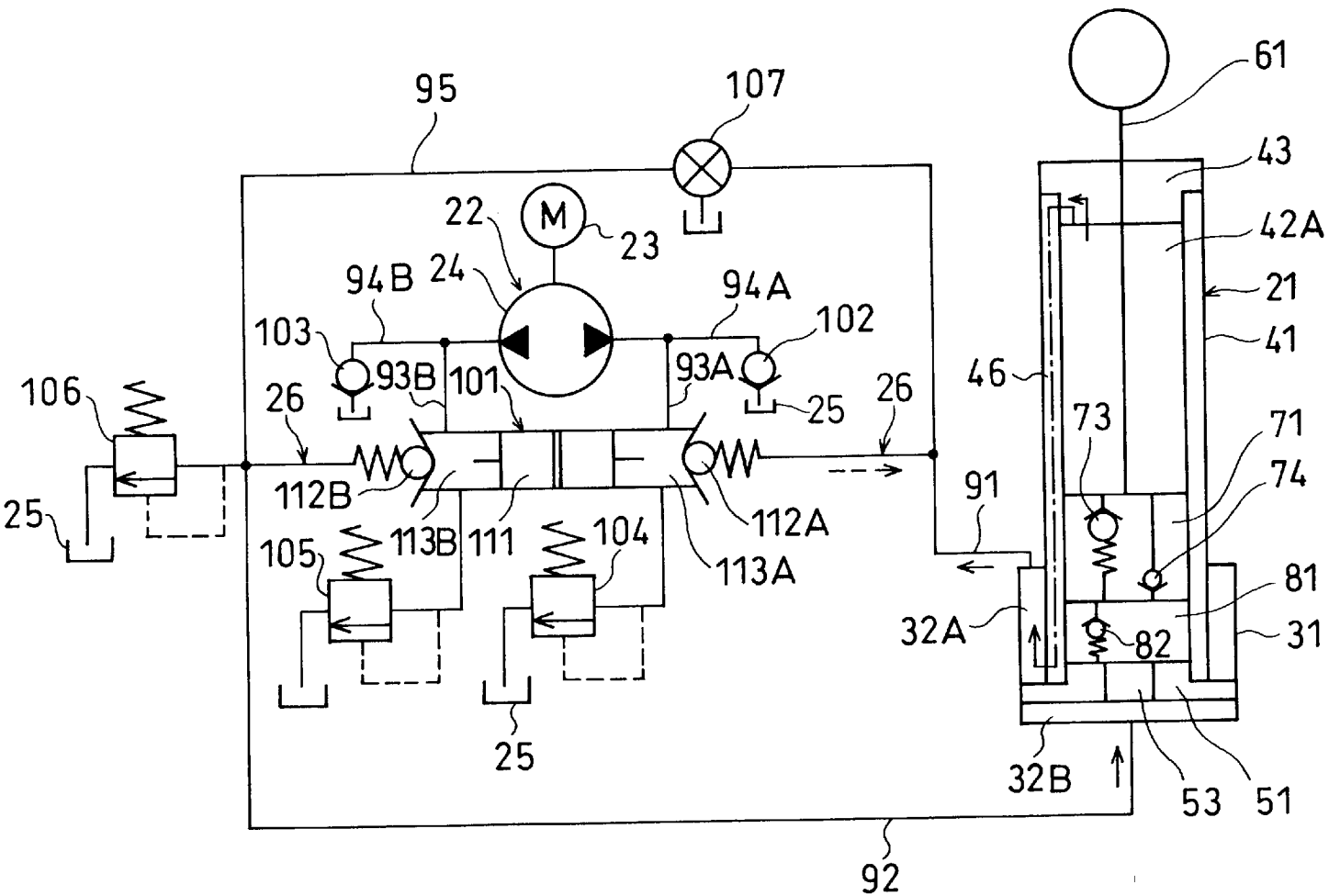
FIG. 5 is a view illustrating a trim-operational state of a hydraulic circuit of the trim-tilt device.

(1) Trim-Up (FIG. 5)

When the motor 23 and pump 24 are rotated in reverse, the hydraulic fluid discharged from the pump 24 flows from the pipe passage 93B to the second shuttle chamber 113B of the shuttle type switching valve 101, whereby the shuttle piston 111 moves to the right side in FIG. 5 to thereby forcibly open the first check valve 112A. Also, the hydraulic fluid that has flown into the second shuttle chamber 113B of the switching valve 101 forcibly opens the second check valve 112B by its own pressure and is thereby sent to the second trim chamber 32B through the pipe passage 92 as indicated by a solid-line arrow. The hydraulic fluid that has flown into the second trim chamber 32B in this way tends to push up the trim piston 51. It is to be noted that the hydraulic fluid of the second trim chamber 32B not only acts on the trim piston 51 but also acts on the tilt piston 71 in close contact with the trim piston 51 through the through-hole connecting passage 53 of the trim piston 51 and that, however, since the pressure-receiving area of the connecting passage 53 is set so that the pressure-receiving area of the trim piston 51 may be larger than that of the tilt piston 71, the trim piston 51 pushes up and moves the tilt piston 71. At this time, the hydraulic fluid of the first trim chamber 32A flows out into the first flow passage 91 and further returns to the pump 24 and therefore the trim piston 51 is moved. Simultaneously, the cylinder 41 and piston rod 61 are caused to protrude outwardly from the housing 31, whereby trim-up is performed. And when the trim piston 51 has collided with the stroke end in the trim-up direction within the first trim chamber 32A, the trim-up becomes maximum.

Figure 6:
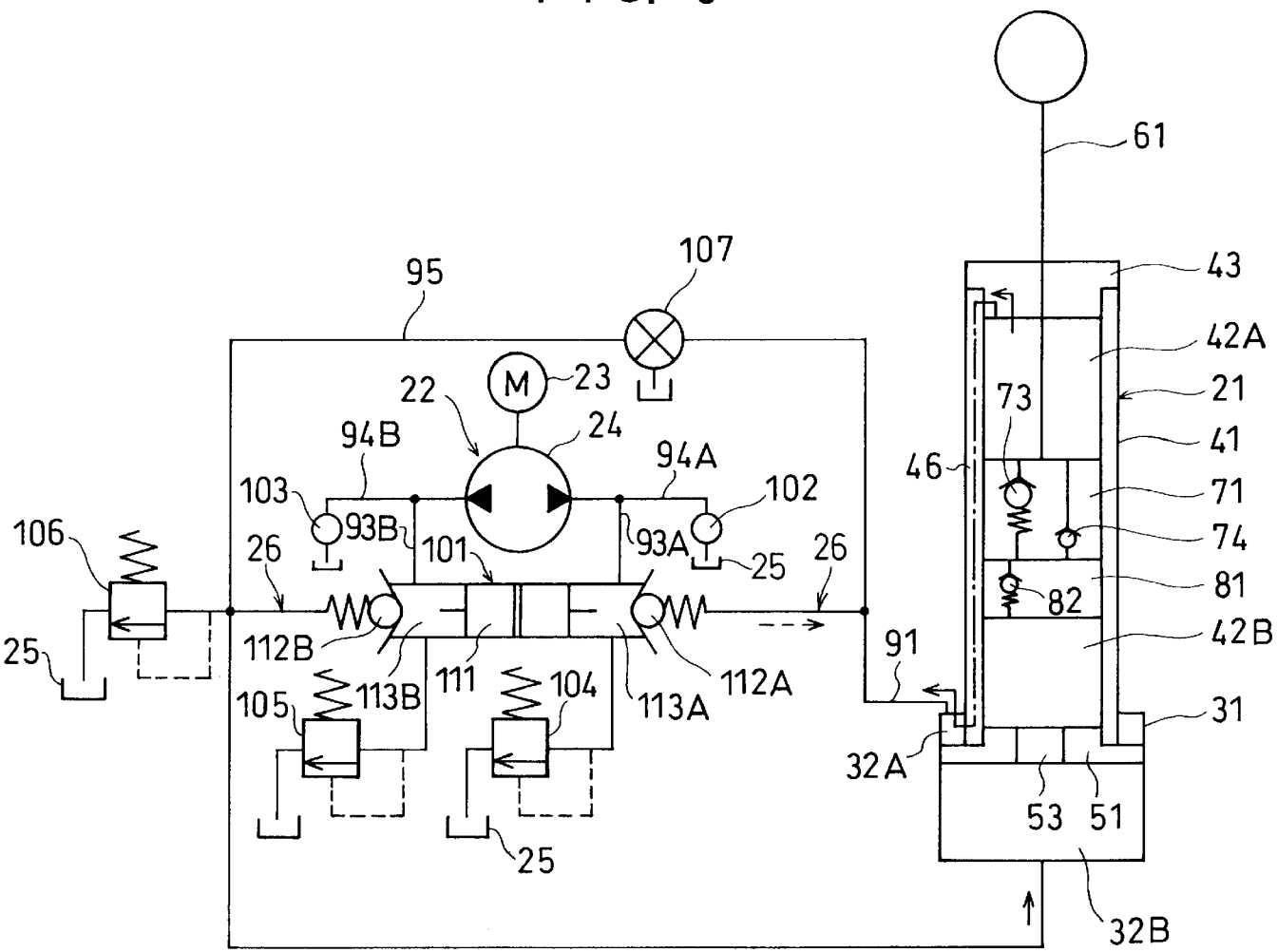
FIG. 6 is a view illustrating a tilt-operational state of a hydraulic circuit of the trim-tilt device.

(2) Tilt-Up (FIG. 6)

When after under the above item (1) the trim piston 51 has been moved up to a level corresponding to the maximum trim-up the hydraulic fluid is further supplied to the second trim chamber 32B. The hydraulic fluid within the second trim chamber 32B extends from the through-hole like connecting passage 53 formed in the trim piston 51 to an anti piston-rod 61 side of tilt piston 71 end surface through the free piston 81. As a result of this, the hydraulic fluid supplied to the second trim chamber 32B is filled into the second tilt chamber 42B formed while being gradually expanded between the trim piston 51 within the cylinder 41 and the free piston 81 (and the tilt piston 71). And the hydraulic fluid within the first tilt chamber 42A flows out into the first flow passage 91 through the passage 91A formed in the rod guide 43 of the cylinder 41, connecting passage 46 of the cylinder 41, passage 91B formed in the outer cylinder 41B of the cylinder 41, passage 91C formed in the cylinder guide 34 of the housing 31 and first trim chamber 32A. Therefore, only the tilt piston 71 alone is moved. As a result of this, the piston rod 61 protrudes outwardly from the cylinder 41, whereby tilt-up occurs. When the tilt piston 71 collides with the stroke end in the tilt-up direction within the first tilt chamber 42A, the tilt-up reaches maximum.

(3) Tilt-Down (FIG. 6)

When the motor 23 and pump 24 are rotated in forward direction, the hydraulic fluid discharged from the pump 24 flows from the pipe passage 93A into the first shuttle chamber 113A of the switching valve 101, whereby the shuttle piston 111 is moved to the left side in FIG. 6 to thereby forcibly open the second check valve 112B. The hydraulic fluid that has flown into the first shuttle chamber 113A of the switching valve 101 forcibly opens the first check valve 112A by its own pressure and, as indicated by a broken-line arrow, is sent from the first flow passage 91 to the first tilt chamber 42A through the first trim chamber 32A, passage 91C, passage 91B, communication passage 46 of the cylinder 41 and passage 91A. When hydraulic fluid flows into the first tilt chamber 42A in this way, the hydraulic fluid pushes down the tilt piston 71 (and the free piston 81). It is to be noted that, at this time, the hydraulic fluid of the first trim chamber 32A acts on the trim piston 51. However, the pressure-receiving area of the tilt piston 71 facing the first tilt chamber 42A is so set as to become larger than that of the trim piston 51 facing the first trim chamber 32A and therefore only the tilt piston 71 alone is depressed until the tilt piston 71 collides with the trim piston 51. As a result of this, the piston rod 61 is retracted into the cylinder 41 and is tilted down. At this time, the hydraulic fluid of the second tilt chamber 42B flows out from the through-hole connecting passage 53 of the trim piston 51 into the second flow passage 92 through the second trim chamber 32B and further into the pump 24. And when the tilt piston 71 collides with the trim piston 51 that is kept at the stroke end in the trim-up direction of the trim chamber 32, the tilt-down is completed.

(4) Trim-Down (FIG. 5)

When after the tilt-down described above (3) terminates, the hydraulic fluid is supplied to the first trim chamber 32A and first tilt chamber 42A, the tilt piston 71 (and the free piston 81) is depressed down to the second trim chamber 32B side integrally with the trim piston 51. The hydraulic fluid within the second trim chamber 32B flows out into the second passage 92, with the result that the cylinder 41 and piston 61 are retracted further into the housing 31 for trim-down operation. And when the trim piston 51 collides with the stroke end in the trim-down direction within the second trim chamber 32B, the trim-down is completed.

Here, in the trim-tilt device 22, during a transition process from the trim-up to the tilt-up operation under the above items (1) and (2) and during a transition process from the tilt-down to the trim-down operation under the above items (3) and (4), the effective area of each of the pistons 51 and 71 varies between the large-diameter trim piston 51 and the small-diameter tilt piston 71. For this reason, the transfer speed of the piston rod 61 is such that transition speed in the trim region<that in the tilt region while, on the other hand, the force that acts on the piston rod 61 is such that this force in the trim region>that in the tilt region. In the above-described embodiment, it is possible, (a) in the trim region, to finely adjust the trim angle while resisting the thrust force of the propeller and also to sail in a shallow water area, and (b) in the tilt region (b) it is possible to perform speedy tilt-up/down operations with a relatively small magnitude of force that is necessary for supporting the weight of the propulsion unit itself.

Therefore, according to the above-described embodiment, there are the following advantages.

(1) Since the first trim chamber 32A and the first tilt chamber 42A have been interconnected with each other by the passage 46 provided in the wall of the cylinder 41, the exposure to the outside of the pipes of hydraulic fluid supplied and discharged from the supply/discharge device 22 to cylinder device 21 can be suppressed. As a result of this, the outer appearance of the cylinder device 21 is compact and there is no likelihood that exposed pipings will be damaged and that hydraulic fluid will leak from the connection. At this time, since the connecting passage 46 between the first trim chamber 32A and the first tilt chamber 42A is provided within the wall of the cylinder 41, the cylinder device 21 is simple in construction.

(2) The portions where the cylinder 21 should be fluid-tightly sealed are only four in number and those include a portion (seal member 35) where the cylinder 41 slides on the cylinder guide 34 provided in the housing 31, a portion (seal member 52) where the trim piston 51 slides on the inner surface of the trim chamber 31 of the housing 31, a portion (seal member 44) where the piston rod 61 slides with respect to the rod guide 43 provided in the cylinder 41 and a portion (seal member 72) where the tilt piston 71 slides on the inner surface of the tilt chamber 42 of the cylinder 41. Therefore, the sealability of the cylinder 21 is greatly improved.

(3) The tilt piston 71 is moved up and down merely by sliding contact of its outer peripheral portion with the inner surface of the tilt chamber 42 of the cylinder 41 which is made during the tilt operation. Therefore, the assembling efficiency and slidability thereof are high and so the tilt-operating efficiency is improved.

(4) By making the cylinder 41 of the cylinder device 21 into a double-cylinder structure, the double-cylinder structure is made up through the connection of the inner pipe 41A and the outer pipe 41B and the gap between the both pipes 41A and 41B can be used as the connecting passage 46 between the first trim chamber 32A and first tilt chamber 42A. As a result of this, the construction of the cylinder 21 is greatly simplified.

(5) By building the pump 24, tank 25 and switching valve equipped flow passage 26 of the hydraulic fluid supply/discharge device 22 into the housing 31 of the cylinder 21, the connecting flow passages between the hydraulic fluid supply/discharge device 22 and the cylinder device 21 are not outwardly exposed and it is possible to eliminate all use of exposed pipings over the entire trim-tilt device 20 with (1).

(6) The hydraulic fluid supply/discharge device 22 is integrally assembled to the cylinder device 21. Only by respectively connecting the housing 31 and piston rod 61 of the cylinder device 21 to the hull 11 and marine propulsion unit 10, the mounting of the hydraulic fluid supply/discharge device 22 also is simultaneously completed.

However, in the present invention, the connecting passage that is built into the wall of the cylinder and that connects the first trim chamber and the first tilt chamber with each other may be constructed of a hole-like passage formed in the wall of the cylinder. At this time, the cylinder may be formed using a casting and the hole-like passage may be formed by casting. Or the cylinder may be formed using a pipe and the hole-like passage may be formed in the wall of the pipe.

As has been described above, although the embodiment of the present invention has been described in detail with reference to the drawings, the specific construction of the present invention is not limited to this embodiment and the invention includes, for example, changes in design as well which are made without departing from the spirit and scope of the invention.

As has been described above, according to the present invention, in the trim-tilt device for a marine propulsion unit, it is possible, while simplifying the construction of the cylinder device, to eliminate the exposure of the piping around the cylinder device, to improve the sealability of the cylinder device and to enhance the tilt-operating efficiency.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A trim-tilt device for a marine propulsion unit wherein a cylinder device is mounted between a hull and the marine propulsion unit freely tiltably supported by the hull; and wherein a hydraulic fluid is supplied from a hydraulic fluid supply/discharge device into the cylinder device and discharged from the cylinder device into the hydraulic fluid supply/discharge device to thereby expand and contract the cylinder device and thereby trim and tilt the marine propulsion unit, the cylinder device comprising:

a housing connected to one of the hull and marine propulsion unit and forms a large-diameter trim chamber;

a cylinder telescopically inserted into the trim chamber and forming a small-diameter tilt chamber;

a large-diameter trim piston fixed to an end portion of the cylinder within the trim chamber of the housing and serving to partitions the trim chamber into a first trim chamber of a cylinder accommodation side and a second trim chamber of an anti cylinder accommodation side;

a piston rod is connected to the other of the hull and the marine propulsion unit and that is telescopically inserted into the tilt chamber of the cylinder; and a small-diameter tilt piston is fixed to an end portion of the piston rod within the tilt chamber of the cylinder and serving to partitions the tilt chamber into a first tilt chamber of a piston rod accommodation side and a second tilt chamber of an anti piston rod accommodation side, a passage formed in a wall of the cylinder for connecting the first trim chamber and the first tilt chamber with each other, whereby the first trim chamber and the first tilt chamber are connected with a supply side of the hydraulic fluid supply/discharge device during a contraction stroke of each trim operation and tilt operation and are connected with a discharge side of the hydraulic fluid supply/discharge device during an expansion stroke, and a passage in the trim piston for connecting the second trim chamber and the second tilt chamber with each other, whereby the second trim chamber and the second tilt chamber are connected with the supply side of the hydraulic fluid supply/discharge device during the expansion stroke of each of the trim operation and tilt operation and are connected with the discharge side of the hydraulic fluid supply/discharge device during the contraction stroke thereof.

2. A trim-tilt device for a marine propulsion unit according to claim 1, wherein the cylinder of the cylinder device is a double cylinder structure and a passage between two cylinders thereof is used as a connecting passage.

3. A trim-tilt device for a marine propulsion unit according to claim 2, wherein the hydraulic fluid supply/discharge device comprises a motor, a pump, a tank and a switching valve equipped flow passage; the motor being installed on a motor-installing surface formed on the housing and being juxtaposed with each other laterally of the cylinder; and the pump, tank and switching valve equipped flow passages being built internally in the housing.

4. A trim-tilt device for a marine propulsion unit according to claim 1, wherein the hydraulic fluid supply/discharge device comprises a motor, a pump, a tank and a switching valve equipped flow passage; the motor being installed on a motor-installing surface formed on the housing and is juxtaposed laterally of the cylinder; and the pump, tank and switching valve equipped flow passages are internal to the housing.

5. A trim-tilt device for a marine propulsion unit according to claim 1, wherein the connecting passage that is built into the wall of the cylinder and connects the first trim chamber and the first tilt chamber with each other is constructed of a hole-like connecting passage formed in the wall of the cylinder.

* * * * *